United States Patent [19]

Shimizu et al.

[11] 4,205,287

[45] May 27, 1980

[54] ELECTROMAGNETIC DEVICE

[75] Inventors: Masami Shimizu, Tokyo; Teiji Hashimoto, Kawasaki, both of Japan

[73] Assignee: Canon Kabushiki Kaisha, Tokyo, Japan

[21] Appl. No.: 931,531

[22] Filed: Aug. 7, 1978

[30] Foreign Application Priority Data

Aug. 11, 1977 [JP] Japan ..... 52/107561[U]

[51] Int. Cl.[2] ..... H01F 7/00

[52] U.S. Cl. ..... 335/271; 335/277

[58] Field of Search ..... 335/270, 271, 272, 276, 335/277, 279

[56] References Cited

U.S. PATENT DOCUMENTS

| | | | |
|---|---|---|---|
| 3,198,996 | 8/1965 | Vollprecht | 335/271 X |
| 3,259,811 | 7/1966 | Dunn | 335/270 |
| 3,323,090 | 5/1967 | O'Brien | 335/276 X |

*Primary Examiner*—George Harris

*Attorney, Agent, or Firm*—Toren, McGeady and Stanger

[57] ABSTRACT

An electromagnetic device adapted to operate with a battery of small capacity and having an armature arranged to move upon energization and de-energization of a coil, to and away from a yoke respectively. In order to insure that, after having been attracted, the armature is in intimate contact with the yoke over the entire prescribed area of interface therebetween, there is provided an annular elastic spacer which may be of round cross-section secured in an annular recess around a pivot pin for the armature at the center of length thereof and fitted in a vertical hole of the armature to permit not only absorption of the shock on the armature, thus protecting the attraction face, but also tilting movement of the armature about the spacer ring with respect to the yoke.

5 Claims, 5 Drawing Figures

ELECTROMAGNETIC DEVICE

BACKGROUND OF THE INVENTION

This invention relates to electromagnetic devices and more particularly to electromagnetic devices for use in photographic cameras.

DESCRIPTION OF THE PRIOR ART

It is known that photographic cameras having electronically operated automatic exposure control apparatus make use of electromagnetic devices for controlling actuation of the shutter and diaphragm. A typical example of such an electromagnetic control device is shown in FIG. 1 as associated with a camera shutter. The device comprises a yoke 2 fixedly mounted on a support plate 1 and having two arms around which respective coils 4 are carried through bobbins 3, the coils being connected through interconnection terminals 4*a* to a control circuit therefor (not shown) and an armature 5 pivotally mounted on one arm of a rear shutter curtain actuating lever 6 at a pivot pin 8 and arranged to be moved away from the attracted position by the force of a spring 7 when the coils 4 are de-energized, as the lever 6 is turned in a clockwise direction as viewed in FIG. 1. When the shutter is cocked, the lever 6 is turned in the reverse direction by a linkage (not shown) whereby the armature 5 is brought into contact with both of the end faces 2*a* of the yoke arms, while still permitting a leaf spring 11 between the back face of the armature 5 and an upwardly extending projection of the lever 6 to control angular position of the armature 5 about the pivot pin 8. Since such electromagnetic control device is adapted to operate with a battery of small capacity incorporated within the camera housing, it is required that each time the device is reset, the armature 5 must be disposed with the front face 5*b* contacting with the end faces of the yoke over the entire prescribed area therebetween. Otherwise, when the armature face 5*b* is inclined at an appreciable angle with respect to the yoke faces 2*a* in either or both of the vertical and horizontal directions, the attraction force is correspondingly weakened to admit of an accidental actuation of the device by a weaker shock given to the camera. To avoid such faulty operation of the camera, the moving parts of the device must be manufactured within severe tolerances of values for each design parameter so that the parallelism between the interacting faces of the armature and yoke is established in every complete device. It is, however, practically impossible to economically manufacture a production run of devices capable of good performance.

A conventional device intended to overcome the above mentioned drawback is shown in FIG. 2 where the pivot pin 8 is provided with an annular projection 8*a* around the periphery thereof at the center of its length so that the armature 5 is held in a slip fit against the projection 8*a* with appropriate clearances on the upper and lower sides of the projection 8*a*. Positioned in a space between the bottom surface of the armature 5 and the lever 6 is a washer 9, while a snap-ring 10 is fixedly secured in an annular groove 8*c* in the upper end of the pivot pin 8 to restrain upward movement of the armature 5. Since the appropriate clearance is created between the upper surface of the armature 5 and the snap-ring 10, the armature 5 is made not only rotatable about the pivot pin 8 but also tiltable with respect to the axis of the pivot pin 8. Even if the axis of the pivot pin 8 deviates from an ideal line perpendicular to the plane of the lever 6, the parallelism between the interacting faces of the armature 5 and the yoke 2 is assured in the attracted position.

A disadvantage of such conventional structure is that when the armature is impelled to and pressed against the yoke by a resetting mechanism (not shown), the force exerted to press the armature is concentrated at the annular projection 8*a*, with the resultant amount of abrasion of the projection 8*a* reaching a large value after a small number of cycles of resetting operations.

Another disadvantage is that when the armature 5 is moved away from the yoke 2, the leaf spring 11 imparts vibrations into the armature 5 so that, in making a series of continuous frame exposures with the help of a motor drive unit, the vibrations during the resetting operation cause the armature 5 to contact with the yoke with great shock. This leads to a deformation of the interacting face of the armature and yoke and to a decrease in the attraction force.

An object of the present invention is to provide an electromagnetic device which will overcome the above mentioned drawbacks of the prior art and which is capable of good performance for the armature and is of lasting quality.

SUMMARY OF THE INVENTION

To achieve this, according to the present invention, the pivot pin for the armature is provided with a circumferential groove at the center of the length thereof, and an annular elastic spacer is mounted within the groove with the outer periphery of the spacer being fitted to engage against the inner periphery of a hole of the armature to hold the latter for pivotal movement not only in the horizontal direction, but also in the vertical direction and in the combinations thereof.

DESCRIPTION OF THE DRAWINGS

These and other aspects of the invention will be more fully understood from the following detailed description and the accompanying drawings, in which.

DETAILED DESCRIPTION OF THE PREFERRED EMBODIMENTS

Figure 1:
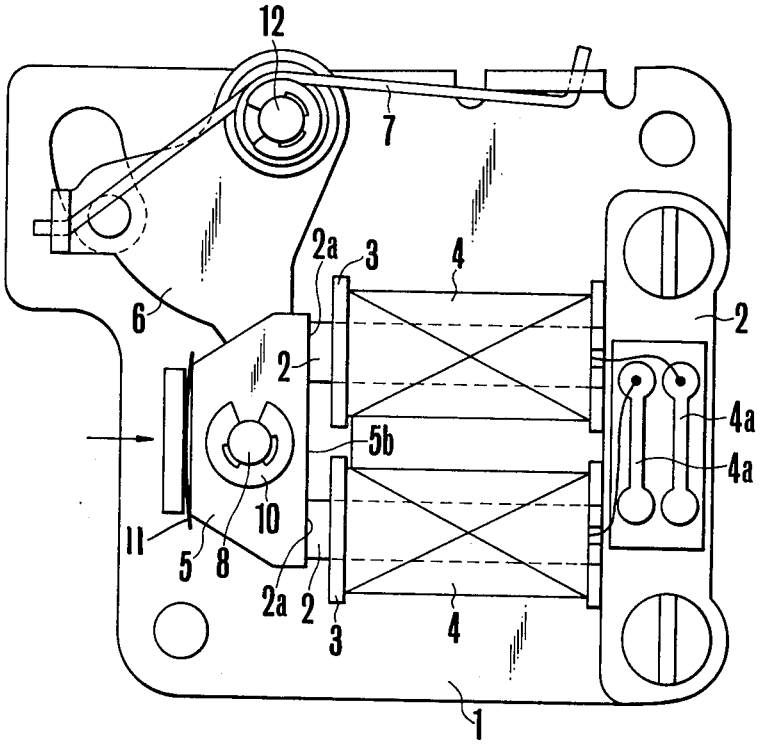
FIG. 1 is a top plan view of an example of an electromagnetic device to which the present invention relates.
Figure 2:
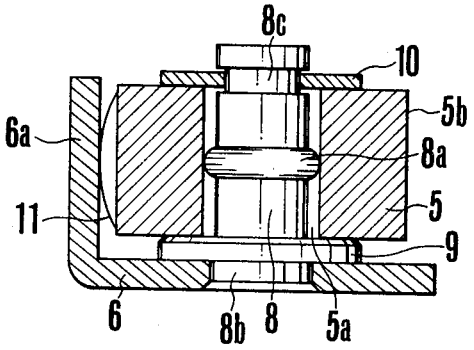
FIG.2 PRIOR ART
FIG. 2 is a sectional view of a conventional armature mounting mechanism.
Figure 3:
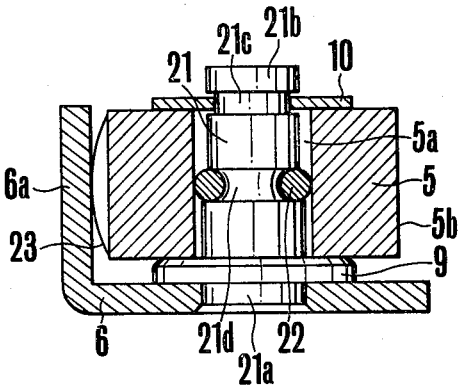
FIG. 3 is a sectional view of one embodiment of the present invention.

Referring to FIG. 3, there is shown an armature mounting mechanism of the present invention, where the same reference characters have been employed to denote parts similar to those shown in FIGS. 1 and 2. A pivot axle 21 for an armature 5 of the same construction as the above is fixedly secured on an armature lever 6 at the bottom end 21*a* thereof, the opposite or top end 21*b* of which has an annular groove 21*c* of rectangular profile for a snap-ring 10. The axle 21 is provided with a circumferential groove 21*d* of semi-circular profile to divide the outer periphery into upper and lower sections. The diameter of the upper section as viewed in FIG. 3 is smaller than that of the lower section. A rubber ring 22 of round cross-section is mounted in the groove 21*d*. In the mounted state without the armature 5, the diameter of the outer periphery of the ring 22 is slightly larger than the inner diameter of the hole 5*a* of the armature 5.

When the armature 5 is assembled with the armature lever 6, a washer 9 is at first placed around the pivot axle 21 on the upper surface of the lever 6, then the rubber ring 22 is inserted while being radially expanded by a slight amount. At this time, the ring 22 after becoming resiliently engaged in the groove 21*d* is prevented from further downward movement because of the larger diameter of the lower section of the pivot axle 21. Next, the armature 5 is mounted on the axle 22 and then the snap-ring 10 is pushed into the groove 21*c* from the lateral direction and thereby the armature 5 is restrained from upward movement. In this state, the ring 22 is slightly compressed by the armature hole 5*a*, and the armature 5 is rotatable about the ring 22 against the friction exerted by the expansion force of the ring 22. The armature 5 is also vertically movable by a slight distance. A leaf spring 23 is inserted into a space between the back face of the armature 5 and the upwardly extending projection of the lever 6 so that the entire area of the interacting face of the armature is uniformly pressed against the two interacting surfaces 2*a* of the yoke 2.

With such construction, when the armature 5 is attracted to the yoke 2, an intimate contact between the armature face 5*b* and the yoke faces 2*a* is established regardless of whether or not the pivot axle 21 is parallel to the plane of the yoke faces 2*a*. Accordingly, the possibility of occurrence of accidental actuation of the electromagnetic device by a weak shock is reduced. Further, the cyclical repetition of attracting and releasing operation does not cause as large an amount of abrasion as occurs in the prior art, so that there is avoided reduction of the attraction force. Furthermore, the vibrations which would be otherwise caused by the leaf spring 23 when the armature is moved away from the yoke are absorbed by the rubber ring 22 to prevent rotative vibrations so that even when a series of continuous frame exposures at a high frequency with the help of a motor drive unit, there is avoided the occurrence of vibrations which cause the armature to impact with the yoke to result in formation of flaws on the interacting surfaces of the armature 5.

The present invention has been described in connection with a type of electromagnetic device in which when the coil 4 is energized, the armature 5 is moved toward the yoke, and when the coil 4 is de-energized, the armature 5 is moved away from the yoke 2. However, the principles of the present invention are applicable to another type of electromagnetic device in which there is provided a permanent magnet between the two arms of the yoke to retain the armature in the attracted position, and wherein energization of the coil operates to release the armature 5 from the attraction of the permanent magnet as the magnetic flux of the permanent magnet is cancelled out by that of the energized coil.

Figure 4:
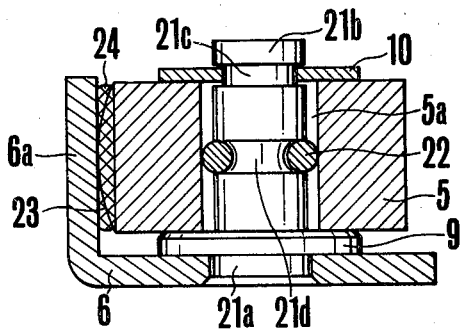
FIGS. 4 and 5 are similar views showing two different examples involving modification of the device of FIG. 3.

FIG. 4 shows an example of modification of the device of FIG. 3 wherein the space between the armature 5 and the upward projection 6*a* is filled with a silicone rubber adhesive 24 to absorb the vibrations of the leaf spring 23.

Figure 5:
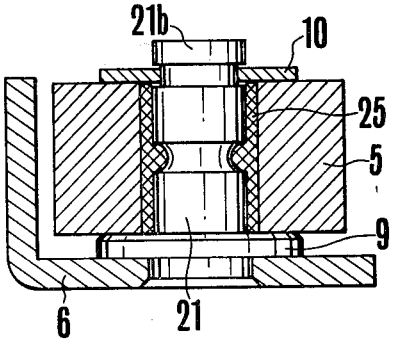

FIG. 5 shows another embodiment of the present invention which is different from that of FIG. 3 in that instead of using the rubber ring 22, a silicone rubber adhesive 25 is injected into a space between the armature 5 and the pivot axle 21 after the lever 6 is set in the latching position and the armature 5 is in intimate contact with the yoke over the entire prescribed area therebetween. Upon solidification of the silicone rubber adhesive, the relative angular position of the armature 5 is fixed so that when the device is reset with energization of the coil 4, the armature 5 is always brought into good contact with the yoke as the device operates with a battery of small capacity. In this case, the pivot axle 21 functions only to support the armature 5 without relative movement of the armature 5 relative thereto so that there is no possibility of occurrence of abrasion. Further, as external shocks are absorbed by the rubber filler, accidental movement of the armature 5 away from the yoke does not occur.

While specific embodiments of the invention have been shown and described in detail to illustrate the application of the inventive principles, it will be understood that the invention may be embodied otherwise without departing from such principles.

What is claimed is:

1. An electromagnetic device comprising: an armature adapted to be electromagnetically energized including a top face, a bottom face and means defining a hole extending continuously through said armature from said top face to said bottom face; an armature lever mounted for rotative movement; a pivot axle formed with a circumferential groove on the outer periphery thereof fixedly mounted upon said armature lever and having said armature mounted thereon, said pivot axle extending through said armature hole and having an outermost diameter smaller than the diameter of said armature hole to define a gap therebetween; spring means applying to said armature lever a spring biasing force in a direction counteracting the force applied thereto by electromagnetic energization of said armature, said counteracting spring biasing force being weaker than the force applied by said electromagnetic energization of said armature; and a body of resilient material secured in said gap between said pivot axle and said armature hole to resiliently support said armature relative to said armature lever.

2. An electromagnetic device according to claim 1 wherein said resilient material is filled in said gap between said armature hole and said pivot axle.

3. An electromagnetic device according to claim 1 wherein said body of resilient material is formed with an annular configuration having a circular cross section and wherein said body is secured within said circumferential groove on said armature periphery.

4. An electromagnetic device according to claim 1 which includes an electromagnet having an attraction face and wherein said armature includes an attraction face, said device further including spring means interposed between said armature lever and said armature to apply a spring force tending to impel said attraction face of said armature to said attraction face of said electromagnet.

5. An electromagnetic device according to claim 1 wherein said pivot axle is formed with an upper section above said circumferential groove and with a lower section below said groove, said lower section having a larger diameter than said upper section.

* * * * *